US005323680A

United States Patent [19]

Miller et al.

[11] Patent Number: 5,323,680

[45] Date of Patent: Jun. 28, 1994

[54] DEVICE AND METHOD FOR AUTOMATICALLY TUNING A STRINGED MUSICAL INSTRUMENT

[76] Inventors: Mark D. Miller, 675 Shadyside Dr.; Jan M. Strock, 540 Nelson St., both of Chambersburg, Pa. 17201

[21] Appl. No.: 890,140

[22] Filed: May 29, 1992

[51] Int. Cl.[5] ..... G10G 7/02

[52] U.S. Cl. ..... 84/455; 84/DIG. 18

[58] Field of Search ..... 84/304, 312 R, 454, 84/455, 458, DIG. 18

[56] References Cited

U.S. PATENT DOCUMENTS

| | | | |
|---|---|---|---|
| 3,881,389 | 5/1975 | Allen | 84/454 |
| 4,023,462 | 5/1977 | Denov et al. | 84/454 |
| 4,041,832 | 8/1977 | Risch | 84/454 |
| 4,044,239 | 8/1977 | Shimauchi et al. | 235/151.3 |
| 4,077,298 | 3/1978 | Kondo | 84/454 |
| 4,354,418 | 10/1982 | Moravec et al. | 84/454 |
| 4,375,180 | 3/1983 | Scholz | 84/454 |
| 4,457,203 | 7/1984 | Schoenberg et al. | 84/454 |
| 4,535,670 | 8/1985 | Borisoff | 84/312 |
| 4,584,923 | 4/1986 | Minnick | 84/454 |
| 4,791,849 | 12/1988 | Kelley | 84/458 |
| 4,796,509 | 1/1989 | Mizuguchi et al. | 84/454 |
| 4,803,908 | 2/1989 | Skinn et al. | 84/454 |
| 4,889,929 | 12/1989 | St. Denis | 84/454 |
| 4,895,060 | 1/1990 | Matsumoto | 84/616 |
| 4,909,126 | 3/1990 | Skinn et al. | 84/454 |
| 4,928,563 | 5/1990 | Murata et al. | 84/726 |
| 4,991,484 | 2/1991 | Kawashima | 84/603 |
| 5,009,142 | 4/1991 | Kurtz | 84/454 |
| 5,038,657 | 8/1991 | Busley | 84/455 |
| 5,056,404 | 10/1991 | Wyss | 84/725 |
| 5,065,660 | 11/1991 | DeBuda | 84/200 |

FOREIGN PATENT DOCUMENTS 8000873 2/1982 PCT Int'l Appl. .

*Primary Examiner*—William M. Shoop, Jr.
*Assistant Examiner*—Jeffrey W. Donels
*Attorney, Agent, or Firm*—Thomas Hooker

[57] ABSTRACT

A device and method for very rapidly and accurately tuning each string of a guitar by contacting the string perpendicularly in order to change the tension in the string. The device is located at a position between the bridge of the guitar and the end of the guitar string. A tensioning member consisting of a shaft and disk is located perpendicularly to each string. The disk has a string engagement means which contacts the string. The tensioning member is connected to a stepping motor. The stepping motor causes the tensioning member to displace axially. The vertical movement of the member causes the disk to contact the string perpendicularly and change the tension in the string, causing the string to become tuned.

28 Claims, 5 Drawing Sheets

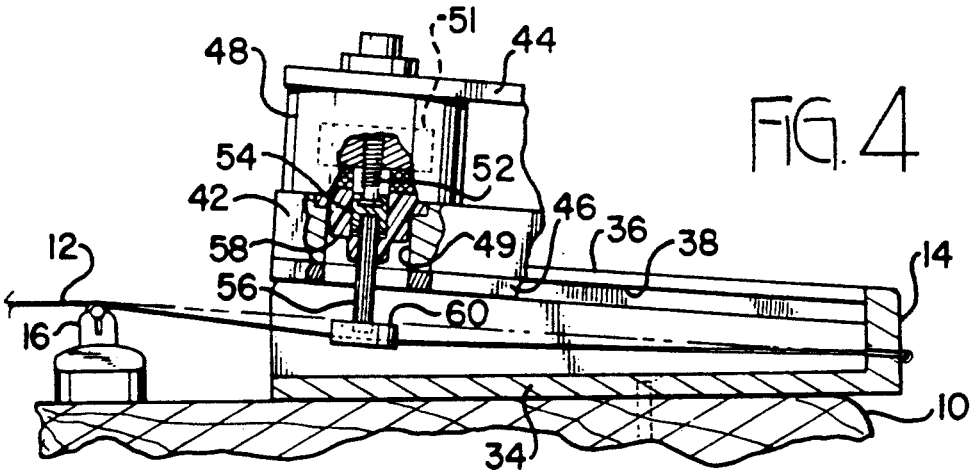
FIG. 4
FIG. 5
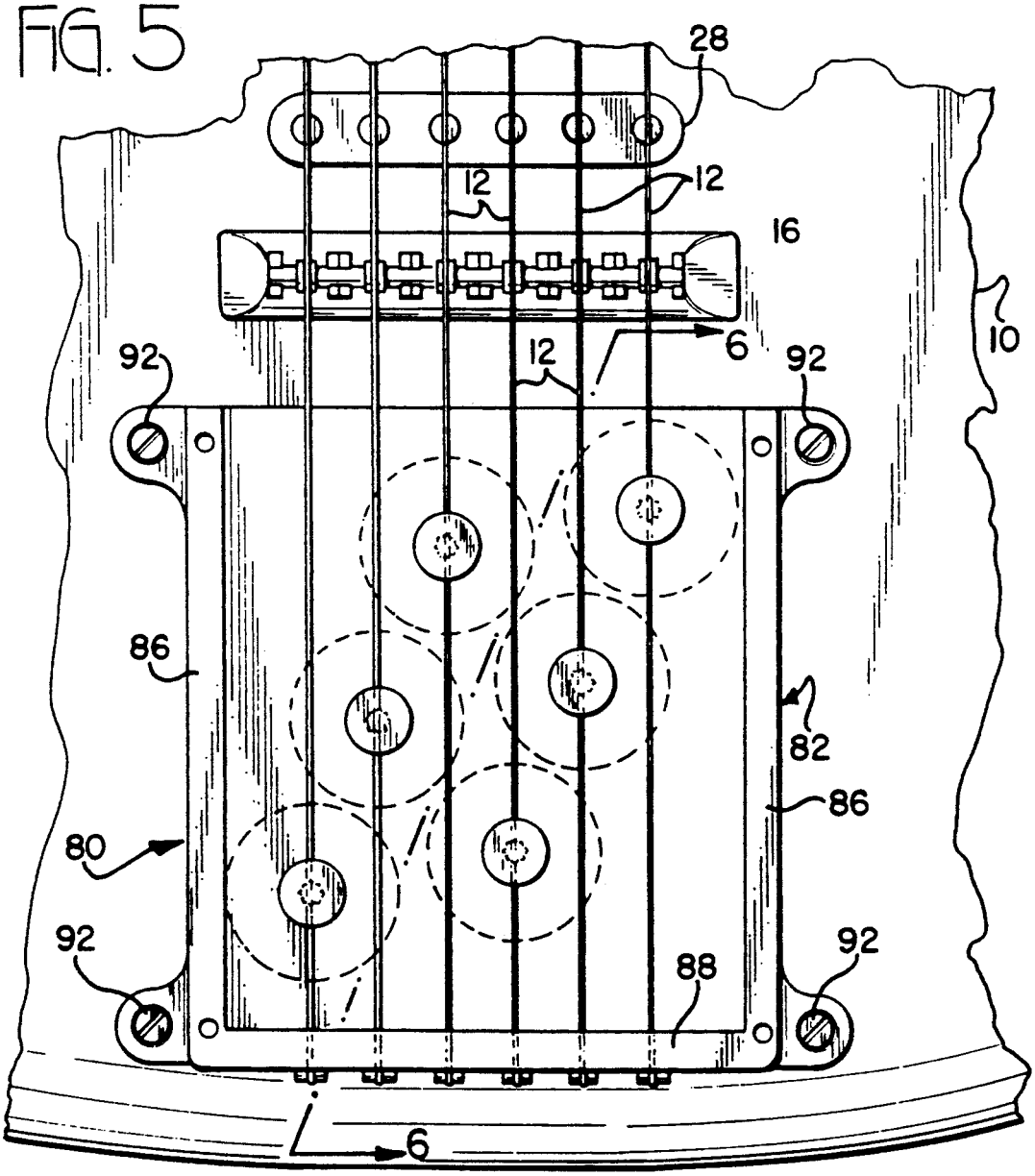

DEVICE AND METHOD FOR AUTOMATICALLY TUNING A STRINGED MUSICAL INSTRUMENT

FIELD OF THE INVENTION

The invention relates to a device and method for rapidly and accurately tuning each of the strings of a stringed musical instrument, typically a guitar.

DESCRIPTION OF THE PRIOR ART

Prior to playing a guitar it is necessary to make sure that the instrument is in tune. Guitars and other stringed instruments require accurate tuning of each string prior to use.

Guitar strings are tuned by increasing or decreasing the tension of the string. If the string is out of tune and "low", then bringing the string in tune is achieved by increasing the tension of the string to increase the vibrating frequency of the string. Conversely, if the string is out of tune and "high", then bringing the string in tune is achieved by decreasing the tension of the string to decrease the vibrating frequency of the string.

Determining whether or not a guitar string is in tune may be achieved by the musician personally listening to and evaluating the sound generated by the guitar string. The determination of whether a guitar string is in tune may also be conducted using a signal processing unit. This unit compares the vibrating frequency of the sound generated by the guitar string with a stored, in-tune reference frequency for the particular string.

If the musician personally evaluates the frequency of the sound generated by the guitar string and the guitar string is out of tune, the musician can alter the tension in the guitar string and change the frequency by manually rotating an adjuster to which the end of the string is secured. In this way, the tension of the string is changed thereby increasing or decreasing the vibrating frequency of the string. This adjuster is typically located above the frets on the guitar. Tuning the guitar string in this manner provides a general or "rough" tuning of the instrument. Moreover, the accuracy of this method of tuning a guitar depends on the ear of the musician, is time consuming and can result in breaking the strings of the guitar.

If the guitar string is tuned using a signal processing unit, the actual frequency of the string is compared to a reference frequency for the string. The processing unit determines whether the string is in or out of tune. Any difference between the two frequencies is translated into a voltage signal used to drive a motor. The motor is connected to a mechanical system connected to the end of the guitar string at the fret end of the guitar. The motor causes the mechanism to tension or loosen the string, thereby respectively increasing or decreasing the vibrating frequency in the string until the string is in tune.

SUMMARY OF THE INVENTION

The present invention is a method and apparatus for rapidly and accurately tuning a stringed musical instrument, typically a guitar. A bracket having downwardly sloped sidewalls is mounted on the guitar body at a location below the guitar bridge. A motor assembly having a plurality of stepping motors is removably mounted on sidewalls of the bracket with each motor located above a guitar string and between the bridge and fixed end of the string. A tensioning member consisting of a shaft and a disk extends from each motor to engage each string. Each disk has a slot that fits over and engages a string.

The strings are tuned individually. Prior to tuning the string, the musician causes the slot of the disk to engage the individual string being tuned. The string being tuned is plucked by the musician, thereby generating a signal having a frequency. This frequency is sensed and transferred to a signal processor which compares the frequency of the string to a stored "in tune" reference frequency for the string. If there is a difference between the two frequencies, then the string is out of tune.

The deviation in frequency is translated into a voltage by the signal processor and the voltage is transferred to the stepping motor located above the string being tuned. The stepping motor moves the tensioning member transversely of the string and, by this motion, causes the member to increase or decrease the tension in the string and vary the vibrating frequency of the string until the string is in tune.

The stepping motors move the tensioning members against the strings. The rotary motion of the motor armature is converted to an axial movement exerted directly against the string to fine tune the string. The ability to make fine adjustments to the tension of the guitar string when tuning the guitar string results in rapid, accurate tuning and fewer strings breaking during tuning.

The guitar tuning device is designed so that the device is removably mounted on the guitar when the guitar is in use. Typically the harder and longer the guitar is played the more the instrument goes out of tune. By designing the tuning device so that it remains on the guitar during use, a performer can easily retune the instrument during breaks in a performance and thereby maintain the instrument in tune. In a second embodiment of the invention, the motor assembly used to vary the tension of the strings is permanently mounted on the guitar in a cavity below the strings.

Other objects and features of the invention will become apparent as the description proceeds, especially when taken in conjunction with the accompanying drawings illustrating the invention, of which there are five sheets and two embodiments.

DESCRIPTION OF THE DRAWINGS

FIG. 4 is a sectional view taken along line 4—4 of FIG. 2;

FIG. 5 is a view like FIG. 2 of a second embodiment of the invention with a coverplate removed;

DESCRIPTION OF THE PREFERRED EMBODIMENT

Figure 1:
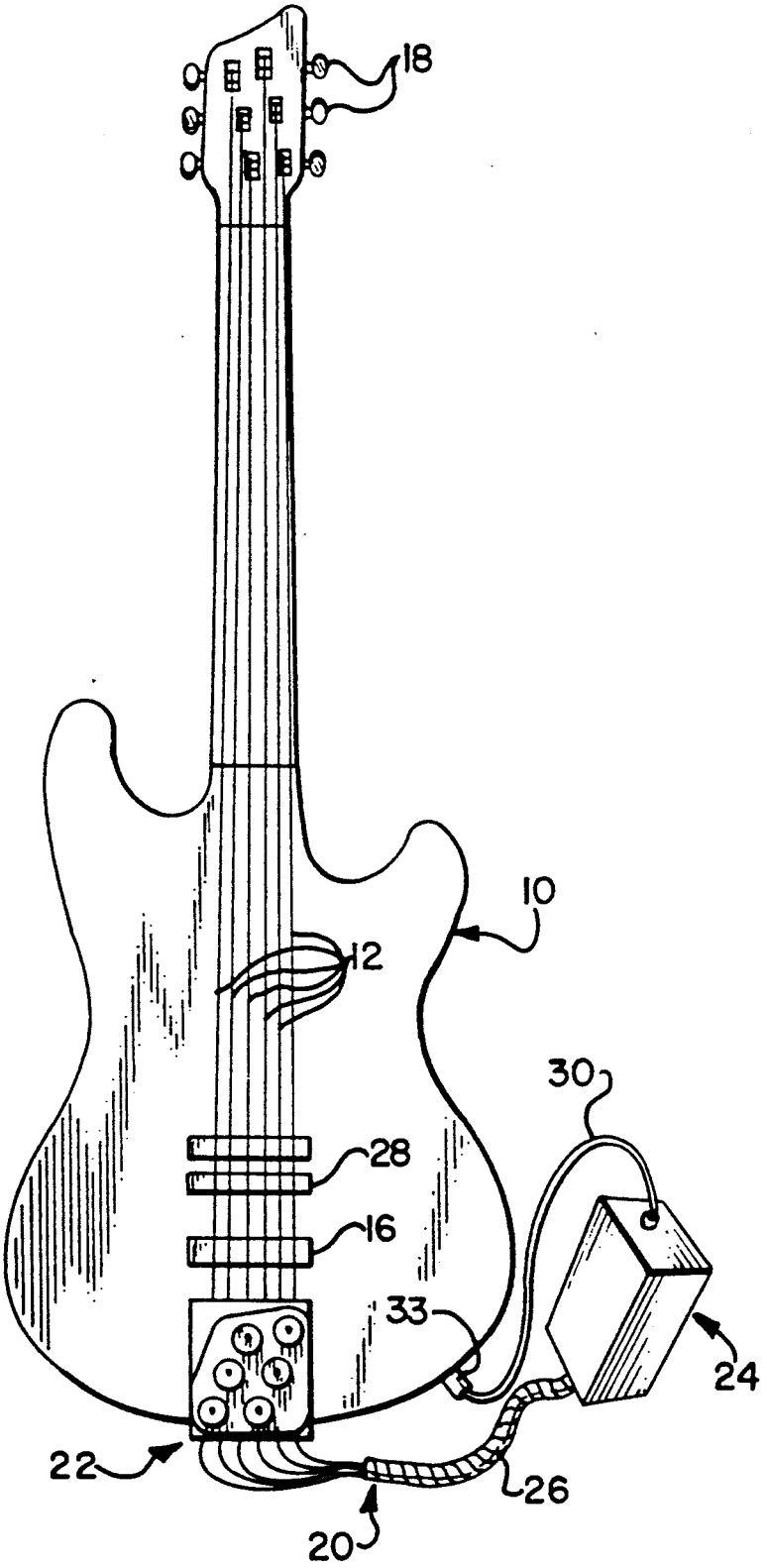
FIG. 1 is a view showing the location of a first embodiment tuning apparatus on an electric guitar and the connection with the signal processor circuit.

Guitar 10, which may be of the electric or acoustic type, includes a plurality of strings 12 which extend from a fixed tailpiece 14 at the lower end of the guitar over bridge 16 and are individually connected to manual tension adjusters 18 at the upper or fret end of the guitar.

The automatic string tuning apparatus 20 includes a string tensioning assembly 22 mounted on the lower end of the guitar and including tailpiece 14, an electronic signal processor circuit 24 of conventional design, a power cable 26 connecting the circuit and the control assembly, an electronic pickup 28 mounted on the face of the guitar above the bridge and a pickup cable 30 which connects the processor circuit 24 to the pickup through a jack 33 mounted in the side of the guitar.

Figure 2:
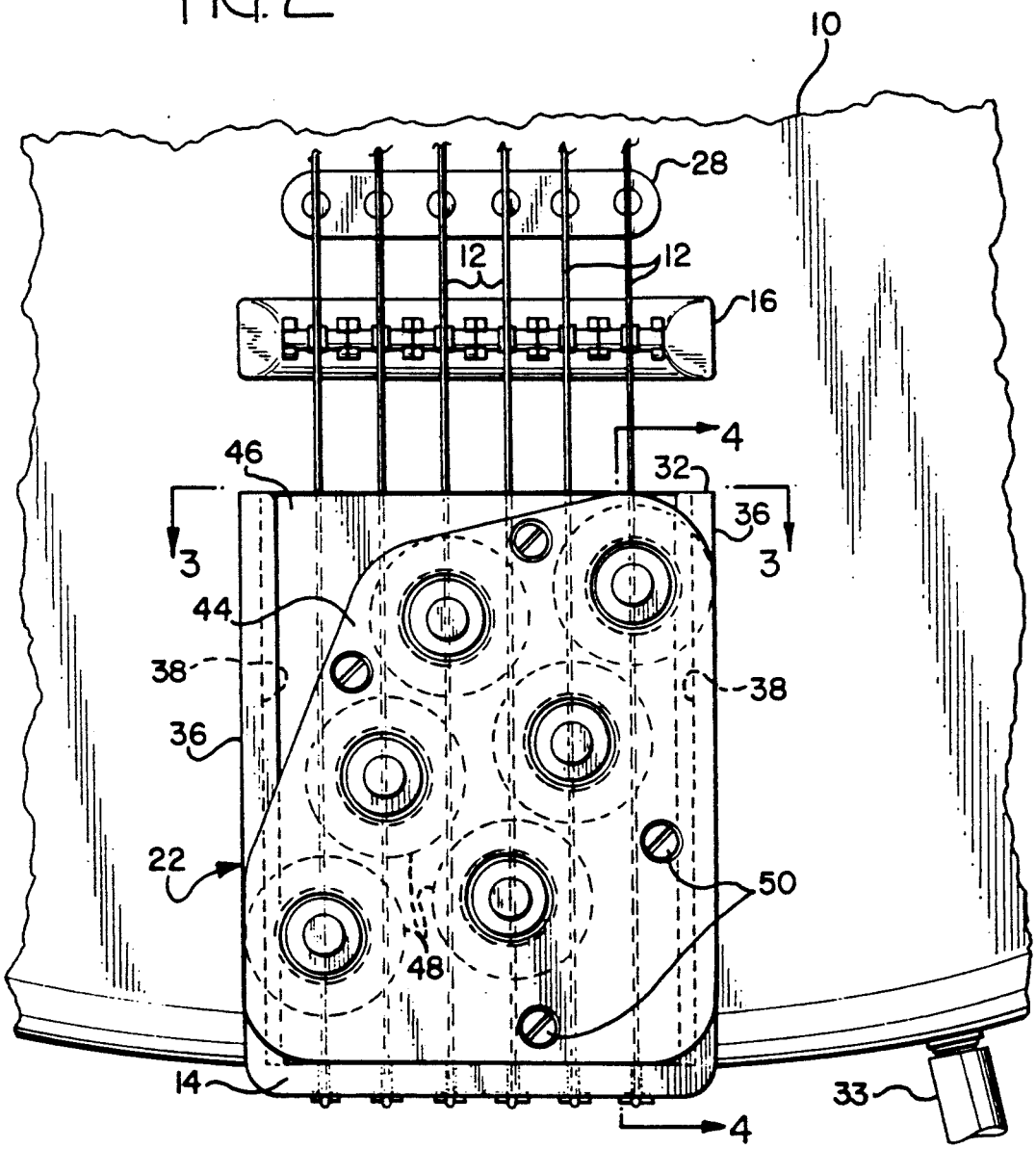
FIG. 2 is an enlarged view of the tension contact assembly of FIG. 1.
Figure 3:
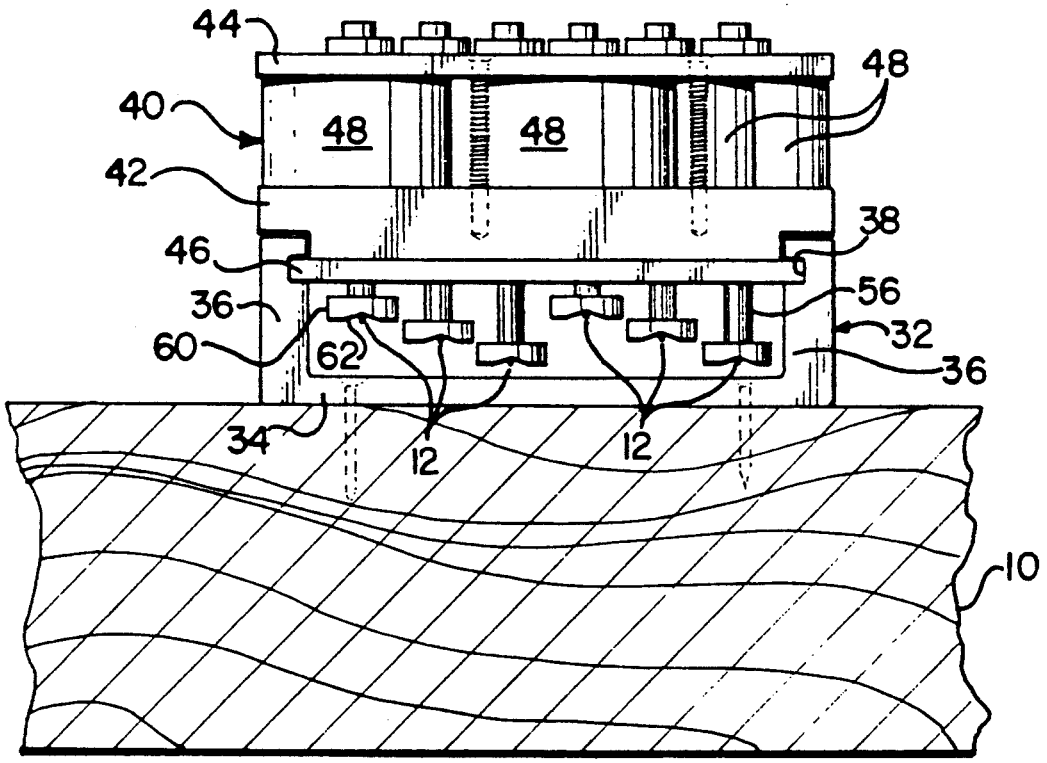
FIG. 3 is a sectional view taken along line 3—3 of FIG. 2.

Referring now to FIGS. 2 and 3, the string tensioning assembly 22 includes a mounting bracket 32 and a motor assembly 40. The bracket has a rectangular base 34 mounted flush on the lower end of the guitar, a pair of opposed parallel sidewalls 36 and an end wall 14 located away from the bridge forming the string tailpiece. The strings 12 extend over the bridge 16 and angle down from the bridge and extend through small openings formed in the tailpiece wall. As shown in FIG. 4, the height of sidewalls 36 tapers downwardly from a maximum adjacent the bridge to a minimum at the tailpiece wall so that the tops of the sidewalls and opposed grooves 38 formed on the inner surfaces of the sidewalls slightly below the tops of the sidewalls generally parallel the strings.

The mounting bracket 32 is rigidly mounted on the lower end of the guitar by screws or other suitable fasteners as illustrated in FIG. 3.

The mounting bracket supports a motor assembly 40 including a tuning motor 48 for each of the strings 12. The assembly 40 includes a motor mounting plate 42 as shown in FIGS. 3 and 4, a coverplate 44 located above and having the same shape as plate 42 and a rectangular groove plate 46 mounted on the lower surface of the plate 42. As illustrated in FIG. 3, the edges of plate 46 extend into the grooves 38 on the mounting bracket and the outer edges of the mounting plate 42 engage the tops of sidewalls 36 to removably mount the motor assembly in place on bracket 32. The assembly may be removed from the bracket 32 when the guitar is not in use.

A plurality of motor-receiving bores 49 are provided in plate 42 to receive a plurality of electrical stepping motors 48 as shown in FIGS. 3 and 4. Because the diameter of each tuning motor is greater than the distance between each string, it is necessary to orient the motor receiving bores on the motor receiving plate in two clusters, each cluster having a group of three motors, as shown in FIG. 2. The clusters are staggered to permit close spacing of the motors. In this way, the axes of the motors are located different distances from the bridge 16. The motors 48 are sandwiched between plates 42 and 44 which are secured together by suitable screws 50. The output shafts 52 of motors 48 are each located above and extend perpendicularly toward the string 12 that is tuned by the motor.

FIG. 4 illustrates that each stepping motor 48 includes a threaded rotary output shaft 52 which turns in a fixed block 51 and engages a non-rotatable coupling member 54, illustrated diagrammatically, that converts rotation of the shaft to longitudinal movement along the axis of the shaft. The coupling member 54 is directly connected to splined shaft 56 which extends from the motor toward the string 12 tuned by the motor. Shaft 56 extends through a stationary shaft support 58 which engages the splines on the shaft so that stepped rotation of motor 48 moves shaft 56 axially through very small increments toward and away from the string. A tensioning disc 60 is mounted on the free end of shaft 56 and includes a diametrical groove 62 that fits over and engages string 12.

The electronic signal generator circuit 6 is connected to each motor 48 through a line in cable 26 as shown in FIG. 1.

The operation of automatic string tuning apparatus 20 will now be described.

Prior to operation of apparatus 20, the musician playing guitar 10 mounts the assembly 22 in bracket 32, plugs in jack 33 and actuates circuit 24. Motors are initially rotated to extend the disks 60 to engage and depress or deflect the strings at locations along straight sections of the strings extending from the bridge to the mounting holes in tailpiece 14. The musician then manually adjusts the tension of strings 12 using adjusters 18 so that the strings are in approximate tune, but flat so that the string tension in the string is less than the tension of properly tuned strings. After manual approximate adjustment, one string 12 is plucked to produce a sound having a frequency close to the proper tuned frequency for the string. This frequency is picked up by the pick up 28 and transmitted to the signal processor circuit 24 through signal wire 30. The processor circuit compares the frequency of the sensed signal to the desired frequency for the string and generates an output signal transmitted through the cable 26 to the appropriate stepping motor 48 for the string 12 being tuned. This signal actuates the stepping motor to extend the shaft 56 the distance required to increase the tension in the string a sufficient amount so that the string assumes a proper tension for generating the proper frequency sound and is then in tune. In practice, the string may be strummed a number of times in order to assure circuit 24 and motor 48 bring the string into exact tune.

Each string 12 is tuned in exactly the same manner to bring all of the strings into proper tune.

In the first embodiment of the invention shown in FIGS. 1–6, the tensioning discs 60 are provided with grooves 62 and are pressed down against the strings 12 and deflect the strings into the recess between the bridge and the tailpiece. If desired, the tensioning discs may be provided with small diametrical holes and the strings may be threaded through the holes so that operation of the motors 48 during tensioning may press the strings down into the recess or, if desired, may pull the strings up and outwardly from the guitar. In either case, the stepping motors vary the tension of the strings to bring them into proper tune. The upward movement is insufficient to lift the strings from the bridge.

The axial forces exerted on the shafts 56 by the strings are insufficient to rotate the stepping motors thereby assuring that once the strings are properly tensioned and in tune, the tension and tune are maintained.

Figure 6:
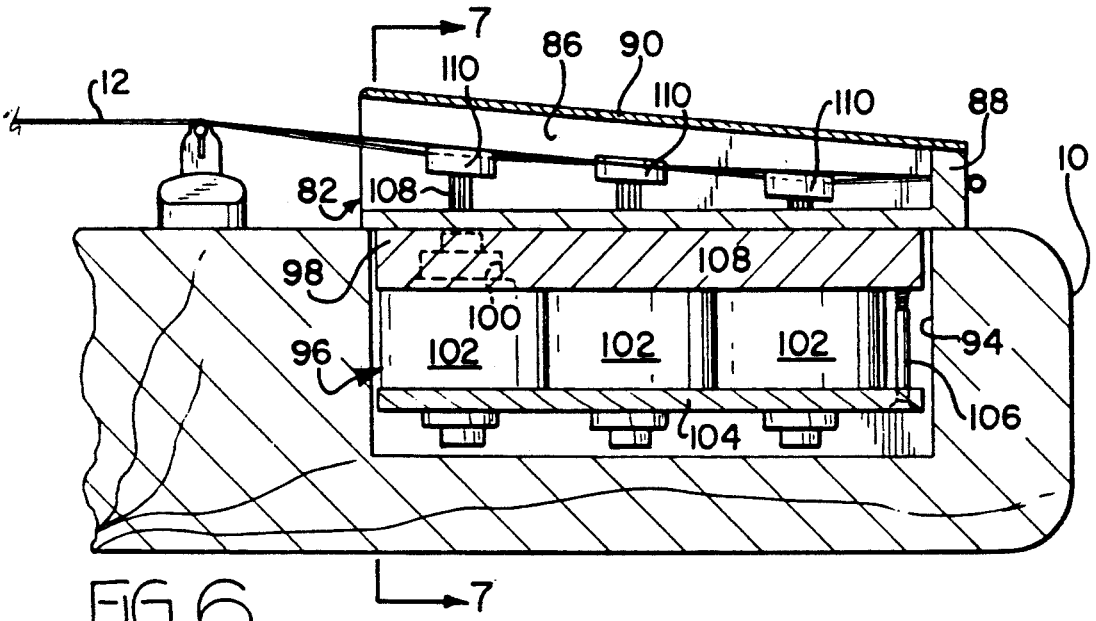
FIG. 6 is a sectional view like FIG. 4 of the second embodiment of the guitar tuning device.
Figure 7:
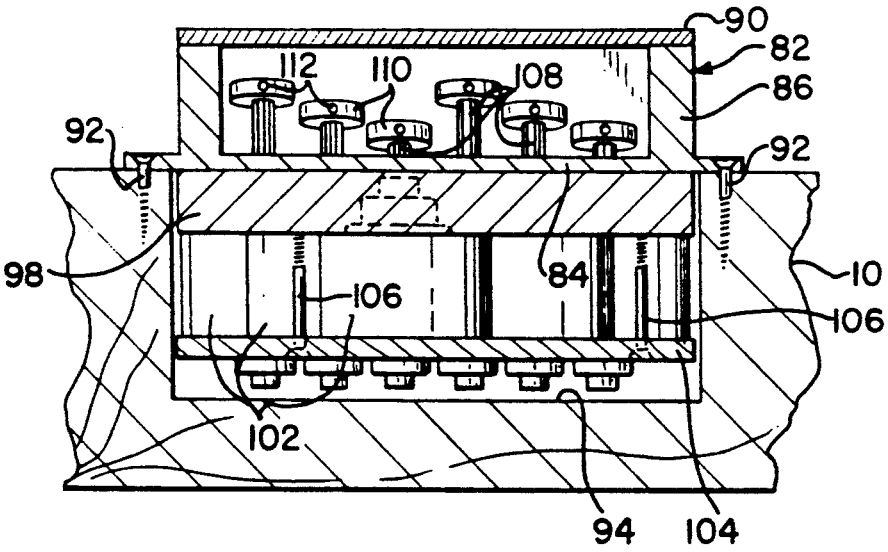
FIG. 7 is a sectional view taken along line 7—7 of FIG. 5.

FIGS. 5–7 illustrate a second embodiment of the invention in which the motor assembly is located within a recess in the body of the guitar, below the strings. In describing the second embodiment, the same reference numbers used in describing the first embodiment will be used to describe similar elements.

The second embodiment automatic string tensioning assembly 80 includes a pick up and an electronic signal process or as in the first embodiment. The assembly also includes a bracket 82 and a motor assembly 96. The mounting bracket 82 has a base 84, sidewalls 86 and end piece 88 similar to bracket 32 of the first embodiment. The sidewalls are tapered like sidewalls 36. Cover 90 is normally mounted on the tops of the sidewalls and tailpiece as shown in FIGS. 6 and 7. Bracket 82 is threadably secured to the top of the guitar by screws 92 shown in FIGS. 5 and 7.

A recess 94 is provided in guitar 10 beneath bracket 82 for receiving a motor assembly 96 mounted permanently on the bottom of bracket base 84. The motor assembly includes a mounting plate 98 secured on plate 84 and having a plurality of motor-receiving recesses 100 each located beneath one of the strings 12 on the guitar. A stepping motor 102 is fitted in each recess. The motors are held in the recesses by a coverplate 104 secured to the mounting plate 98 by screws 106.

A splined output shaft 108 is connected to a threaded rotary shaft of each motor 102 through a rotary movement to axial movement coupling and fixed bushing as described in connection with motors 48 of the first embodiment. Splined shafts 108 connected to each motor extend directly toward one of the strings 12 and each is secured to a tensioning disk 110 having a small diameter bore 112 extending therethrough with the string 12 extending through the bore. The disks may be tilted slightly as shown in FIG. 6 so that the bores generally parallel the strings 12. The shafts 108 extend freely through recesses 100 formed in mounting plate 98 and base 84 in the same way as spline shafts 56 extend through openings 49 in mounting plate 42 and groove plate 46 as shown in FIG. 4.

The second embodiment string tension control assembly operates essentially identically to the operation of the first embodiment automatic string tensioning assembly 20, as previously described. Prior to tuning, motors 10 are actuated to move disks 110 so that the strings extending from the bridge to the tail piece are deflected, preferably downwardly toward the guitar as shown in FIG. 6. The musician then manually tunes the strings by ear so they are slightly flat. Next, the processor circuit 24 is actuated and individual strings are plucked and vibrated to generate a signal transmitted to the processor circuit for actuation of the appropriate motor to increase the tension and accurately tune the string. As previously mentioned, the strings may be vibrated a number of times in order to assure the tensioning apparatus accurately tunes the string in accordance with the proper reference frequency as stored in the processor circuit.

In the first embodiment tensioning apparatus, the motor assembly 40 is removably mounted on the top of the guitar in grooves 38 and is preferably removed from the guitar when the instrument is not being played. In this way, the assembly, processor circuit 24 and wire 30 may be stored in an appropriate protective carrying case to prevent injury between performances.

In the second embodiment tensioning apparatus 80, the motor assembly 96 is permanently located within recess 94 within the guitar and is surrounded by the guitar and mounting bracket 82. The exposed shafts 108 and disks 110 are located within the bracket under coverplate 90 where they are protected from accidental injury during playing and subsequent transport of the guitar.

While the invention has been described in connection with tuning a guitar 10, obviously the tuning apparatus may be used to tune other stringed instruments in which the strings extend over a bridge to a tailpiece and can be deflected laterally to vary the tension of the portion of the vibrating and sound-producing portion of the string.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What we claim as our invention is:

1. An automatic string tensioning apparatus for tuning a stringed musical instrument, said apparatus comprising, a) pickup means for sensing the vibrating frequency of a string;

b) electronic processor circuit means for receiving the vibrating frequency sensed by the pickup means and generating an output signal proportional to the difference between the sensed frequency and a reference frequency; and c) a string tensioning assembly including, i) mounting means for mounting the assembly on a stringed instrument adjacent a length of a string to be tuned;

ii) a string contact element having a contact surface engagable with one side of the string to be tuned between the ends of the string, the contact element being movable toward and away from the string so that the contact surface engages the string and deflects the sting laterally to vary the tension of the string; and iii) drive means connected to the string contact element for moving the string contact element toward or away from the string a distance proportional to the output signal.

2. An automatic string tensioning apparatus as in claim 1 wherein said mounting means includes a mounting bracket and removable mounting means for securing the string tensioning assembly to the bracket.

3. An automatic string tensioning apparatus as in claim 2 wherein said bracket includes a string tailpiece located to one side of the tensioning assembly and is adapted to be mounted on a stringed instrument, the tailpiece defining a string opening for receiving a string to be tuned.

4. An automatic string tensioning apparatus as in claim 1 wherein the string tensioning assembly comprises, d) a bracket;

e) a motor assembly supported by the bracket, the assembly having, i) a plurality of tuning motors;

ii) a tensioning member extending outwardly from each tuning motor, each member including a shaft operatively connected to a spring contact element; and iii) a mounting plate having receiving means for locating each tuning motor and through which each tensioning member extends toward a string of the stringed instrument at a location between the ends of the string.

5. An automatic string tensioning apparatus as in claim 4 wherein the bracket includes a tailpiece through which each string of a stringed instrument passes.

6. An automatic string tensioning apparatus as in claim 4 wherein the bracket includes, f) a base; and g) a pair of sidewalls perpendicular to the base.

7. An automatic string tensioning apparatus as in claim 6 wherein each sidewall of the bracket includes a sloped groove; parts of the mounting plate extending into the grooves.

8. An automatic string tensioning apparatus as in claim 4 wherein the motor assembly is located within the bracket and each tensioning member of the motor assembly extends toward the body of the stringed instrument and is generally perpendicular to and overlies a string.

9. An automatic string tensioning apparatus as in claim 4 wherein the motor assembly is located within a recess in the body of the stringed instrument and each stringed tensioning member extends upwardly from the body of the stringed instrument toward a string.

10. An automatic string tensioning apparatus as in claim 4 wherein the string contact element comprises a slot.

11. An automatic string tensioning apparatus as in claim 4 wherein each string contact element includes a hole having a wall, said contact surface forming part of the wall.

12. An automatic string tensioning apparatus as in claim 11 wherein the hole extends generally parallel to the length of a string.

13. An automatic string tensioning apparatus as in claim 12 wherein the hole extends in a direction transverse to the direction of movement of the string contact element.

14. An automatic string tensioning apparatus as in claim 4 wherein the tuning motors are rotary and including rotary-to-linear couplings between the motors and the string contact elements.

15. An apparatus for automatically altering the vibrating frequency of each string of a stringed musical instrument comprising:

a) a mounting member adapted to be mounted to the body of a stringed musical instrument to position a motor assembly to one side of the strings of the instrument and between the ends of the strings; and b) a motor assembly having, i) a plurality of tuning motors;

ii) a tensioning member extending outwardly from each tuning member and having a shaft and a tensioning element on the shaft with a string engagement surface engagable with one side of a string to deflect a string laterally; and iii) a mounting plate having receiving means for locating each tuning motor, said plate engaging said mounting member.

16. An apparatus as in claim 15 including a tailpiece on said mounting member.

17. An apparatus as in claim 15 wherein the mounting member includes, c) a base; and e) a pair of opposed sidewalls extending away from the base, said motor assembly joining said sidewalls.

18. An apparatus as in claim 17 including a removable connection between the motor assembly and mounting member.

19. An apparatus as in claim 18 wherein said removable connection includes grooves in said sidewalls and portions of said mounting plate extending into said grooves.

20. An apparatus as in claim 15 wherein said string engagement surfaces are concave.

21. An apparatus as in claim 20 wherein said string engagement surfaces each comprise a portion of a hole extending through a tensioning member.

22. An apparatus as in claim 15 wherein the motor assembly includes a plurality of rotary-to-linear couplings located between the tuning motors and the engagement surfaces.

23. The method of tuning a musical instrument of the type having a string secured at one end to a tailpiece, extending over a bridge and secured at the other end to a part of the instrument remote from the bridge, comprising the steps of:

a) vibrating a first portion of the untuned string extending between the bridge and the other end of the instrument to generate a sound having an untuned vibrating frequency;

b) generating a signal having a magnitude proportional to the difference between the untuned vibrating frequency and a desired tuned frequency; and c) laterally displacing a second portion of the string extending between the bridge and the tailpiece a distance proportional to the magnitude of the generated signal to bring the string into tune.

24. The method of claim 23 including the steps of:

d) rotating a motor through an angle proportional to the magnitude of the generated signal;

e) converting the rotary movement of the motor to a linear movement; and f) displacing the second portion of the string a distance equal to the linear movement.

25. Apparatus for automatically altering the vibrating frequency of each string of a stringed instrument, the apparatus comprising, a) a mounting member adapted to be mounted to the body of a stringed instrument to position a motor assembly adjacent and to one side of the strings of the instrument and between the ends of the strings; and b) a motor assembly on the mounting member located over the strings of the instrument, the motor assembly including, i) a plurality of tuning motors;

ii) a tensioning member extending from each motor in a direction toward one of the strings of the stringed instrument and having a shaft and a tensioning element on the end of the shaft engagable with a string intermediate the ends of the string to deflect the string upon movement of the shaft toward or away from the string;

iii) a mounting plate having receiving means for locating each tuning motor over a string; and iv) a rotary connection between each tuning motor and each tensioning member shaft whereby operation of the motor moves the tensioning member toward and away from the string.

26. Apparatus as in claim 24 wherein said each shaft is threaded and each motor rotates a shaft.

27. Apparatus as in claim 26 wherein the tensioning member includes a recess facing a string, said recess defining said string engagement surface.

28. Apparatus as in claim 27 wherein said motor assembly is removable secured to the mounting member.

* * * * *